US010640919B1

(12) United States Patent
Huang et al.

(10) Patent No.: US 10,640,919 B1
(45) Date of Patent: May 5, 2020

(54) LOCKED COIL WIRE ROPE AND CAPACITY EXPANSION FRAMEWORK

(71) Applicant: Guizhou Wire Rope Incorporated Company, Zunyi, Guizhou (CN)

(72) Inventors: Zhongqu Huang, Guizhou (CN); Xiaogang Wang, Guizhou (CN); Xiaoyu He, Guizhou (CN); Zhiyuan Yan, Guizhou (CN); Nan Xia, Guizhou (CN)

(73) Assignee: Guizhou Wire Rope Incorporated Company, Zunyi (CN)

( * ) Notice: Subject to any disclaimer, the term of this patent is extended or adjusted under 35 U.S.C. 154(b) by 23 days.

(21) Appl. No.: 16/204,107

(22) Filed: Nov. 29, 2018

(30) Foreign Application Priority Data

Oct. 17, 2018 (CN) ..... 2018 1 1207819

(51) Int. Cl.
*D07B 1/06* (2006.01)
*D07B 1/10* (2006.01)
*D07B 7/06* (2006.01)

(52) U.S. Cl.
CPC ..... *D07B 1/10* (2013.01); *D07B 1/068* (2013.01); *D07B 1/0693* (2013.01); *D07B 7/06* (2013.01); *D07B 2201/102* (2013.01); *D07B 2201/104* (2013.01); *D07B 2201/1016* (2013.01); *D07B 2201/206* (2013.01); *D07B 2201/2009* (2013.01); *D07B 2201/2016* (2013.01); *D07B 2201/2024* (2013.01); *D07B 2205/3025* (2013.01); *D07B 2501/2015* (2013.01)

(58) Field of Classification Search
CPC ..... D07B 1/0693; D07B 1/0673; D07B 2201/1072; D07B 2201/108; D07B 1/08; D07B 1/144; H01B 5/104
See application file for complete search history.

(56) References Cited

U.S. PATENT DOCUMENTS 3,188,791 A * 6/1965 Grimes, Jr. ..... D07B 1/08 57/215
3,691,751 A * 9/1972 Hiller ..... D07B 1/08 57/215
3,707,839 A * 1/1973 Glushko ..... D07B 1/08 57/9
3,791,131 A 2/1974 Scott
(Continued)

FOREIGN PATENT DOCUMENTS

CN 2307808 Y 2/1999
CN 101748626 A 6/2010
CN 205012128 U 2/2016
(Continued)

*Primary Examiner* — Tajash D Patel
(74) *Attorney, Agent, or Firm* — Wayne & Ken, LLC; Tony Hom

(57) ABSTRACT

A locked coil wire rope includes a circular steel wire inner layer, a central metal core, and a Z-shaped steel wire outer layer. The central metal core has a structure of 1×19W, 1×19S, 1×26WS, 1×31WS, 1×31SW, 1×49SWS or 1×55SWS. The circular steel inner layer includes at least two circular steel wire layers, and a number of steel wires of circular steel wire layer is no less than 18. The Z-shaped steel wire outer layer includes at least one Z-shaped steel wire layer, and a number of steel wires of the Z-shaped steel wire layer is no less than 51. A capacity expansion framework is further disclosed.

9 Claims, 3 Drawing Sheets

(56) References Cited

U.S. PATENT DOCUMENTS

| | | | | |
|---|---|---|---|---|
| 8,525,033 | B2 * | 9/2013 | Grether | D07B 1/02<br>174/128.1 |
| 2015/0113936 | A1 | 4/2015 | Amils et al. | |

FOREIGN PATENT DOCUMENTS

| | | | |
|---|---|---|---|
| CN | 206109855 | U | 4/2017 |
| CN | 107956174 | A | 4/2018 |

* cited by examiner

LOCKED COIL WIRE ROPE AND CAPACITY EXPANSION FRAMEWORK

CROSS-REFERENCE TO RELATED APPLICATIONS

This application claims to Chinese Application No. 201811207819.X with a filing date of Oct. 17, 2018. The content of the aforementioned application, including any intervening amendments thereto, is incorporated herein by reference.

TECHNICAL FIELD

The present disclosure relates to wire ropes, and in particular to a locked coil wire rope with a diameter larger than 80 mm and a capacity expansion framework.

BACKGROUND

There is an increasing demand for wire ropes in spatial structure, large stadiums, tourism cableway, deep winding and other applications. This requires high stranding quality, structure and performance of the wire ropes at the same time. At present, single strand rope of circular steel wires is generally produced. During its use, such single strand rope is subjected to both a primary bending stress from the external circular objects such as a pulley or a reel and a secondary bending stress due to severe squeezing caused by excessive slippage of steel wires between layers of the rope. In a worse case, if a structure of an inner layer of the ropes is relatively loose, a tertiary bending stress may occur. A surface of the rope is not in complete surface contact with the external circular objects, so that the compressive stress is uneven and bending stresses increase. This leads to poor fatigue resistance. At the same time, single strand rope has a small filling factor, low breaking force, short service life and large usage limitations so it can hardly meet actual needs.

In addition, the existing 8/1000 closer does not have enough plant capacity, for it has only eight spools used for manufacturing the steel wire ropes. A locked coil wire rope with a diameter of 80 mm requires at least 40 steel wires in outermost layer and consequently at least 40 spools. So the existing closer is far from meeting the demands for large-diameter steel wire ropes with over 40 steel wires in the outermost layer. Large-diameter locked coil wire ropes with over 100 steel wires and with no more than eight steel wires in the outermost layer can only adopt eight spools to strand at least 12 times of repeated stranding. This leads to extremely low production efficiency. Due to different diameters between the inner layer steel wires and outer layer steel wires in the structural designs, different spools are needed for adaptation. It is impossible for the single 8/1000 closer to finish the production practically. Actually, the locked coil wire ropes with a diameter larger than 80 mm require at least 100 steel wires in total.

SUMMARY

An object of the present disclosure is to provide a locked coil wire rope with a diameter larger than 80 mm which meets the actual needs in spatial structures, large stadiums, tourism cableway, deep winding and other applications.

In one aspect, an embodiment of the present disclosure provides a locked coil wire rope with a diameter larger than 80 mm. The locked coil wire rope includes a circular steel wire inner layer, a central metal core and a Z-shaped steel wire outer layer. The central metal core has a structure of 1×19W, 1×19S, 1×26WS, 1×31WS, 1×31SW, 1×49SWS or 1×55SWS. The circular steel wire inner layer includes at least two circular steel wire layers, and each of the circular steel wire layer has 18 or more steel wires. The Z-shaped steel wire outer layer includes at least one Z-shaped steel wire layer, and the Z-shaped steel wire layer has 51 or more steel wires.

Optionally, the locked coil wire cope has a diameter of 130 mm and the central metal core has a structure of 1×31WS. The circular steel wire inner layer includes seven circular steel wire layers, and steel wires of the seven circular steel wire layers, from the inside out, are in a 18+24+30+36+42+42+48 form. The Z-shaped steel wire outer layer includes three Z-shaped steel wire layers, and steel wires of the three Z-shaped steel wire layers, from the inside out, are in a 57+64+71 form.

Optionally, the locked coil wire cope has a diameter of 120 mm and the central metal core has a structure of 1×31WS. The circular steel wire inner layer includes six circular steel wire layers, and steel wires of the six circular steel wire layers, from the inside out, are in a 18+24+30+33+39+45 form. The Z-shaped steel wire outer layer includes three Z-shaped steel wire layers, and steel wires of the three Z-shaped steel wire layers, from the inside out, are in a 51+58+65 form.

Optionally, the central metal core and the circular steel wire inner layer individually have a tensile strength of 1870 MPa or more, and the Z-shaped steel wire outer layer has a tensile strength of 1770 MPa or more. A surface of the locked coil wire rope has a zinc-aluminium alloy coating with an aluminum content of more than 4.2% and a coating weight of more than 255 g/m$^2$. The surface of the zinc-aluminium alloy coating is unoiled.

Optionally, a cross section of the steel wires of the Z-shaped steel wire layer has a structure selected from one of $Z_3$, $Z_4$, $Z_5$, $Z_6$, $Z_7$ and $Z_8$.

The locked coil wire rope has a reasonable structure of the rope inner layer and steel wire layer that eliminates bending stresses generated by slippage between steel ropes. The surface of the rope outer layer is in complete surface contact with the external circular object so as to disperses stress, so that only the primary bending stress is generated by the contact during use. The section structure of the Z-shaped steel wire of the outer layer of the rope includes an up and down height, a total height, a curvature radius and other parameters, which closely cooperate with the structure and diameter of the rope such that the stranded locked coil wire rope has a large metal sectional area and a large density coefficient. At the same time, the inner layer structure of the circular steel wire of the rope also has the general soft characteristic required for steel wire ropes, high resistance to tension and long service life. The locked coil wire rope of the present disclosure fills the blank of large-diameter locked coil wire rope, and meets the actual needs in spatial structure, large stadiums, tourism cableway, deep winding and other applications.

There exists a problem that the prior art 8/1000 closer cannot produce a large-diameter steel wire rope with over 100 steel wires and a locked coil wire rope with a diameter larger than 80 mm. Another object of the present disclosure is to provide a capacity expansion framework for producing a locked coil wire rope with a diameter larger than 80 mm and over 100 steel wires to solve the above problems. Considering the factors such as running stability of equipment, transmission precision, operability, operation site, environment and safety, the inventor redesigned the spools to achieve a capacity expansion suitable for the production of the above products.

In another aspect, an embodiment of the present disclosure further provides a capacity expansion framework for producing the locked coil wire rope. The capacity expansion framework includes at least six spools, at least six spool axles and a framework body. The spools are arranged on the framework body through the spool axles. The framework body is provided with braking devices configured to brake the spools.

Optionally, the framework body is further provided with at least one roller and the pass-line roller is configured to deliver wires evenly.

Optionally, each of the spool axles is arranged on the framework body through a gland, a screw and a nut.

Alternatively, the spools replace the conventional spools with overall shape of the framework unchanged, and the shape, size, number and positions of the spools and the spacing between the spools are redesigned to ensure smooth and safe transmission.

The capacity expansion framework operates steadily and is easy to use. Featuring high production operation rate, high transmission precision and good reliability, the capacity expansion framework has broken the bottleneck of traditional equipment. It is capable of stranding the large-diameter wire rope with over 100 steel wires and the outermost layer steel wire of the locked coil wire rope with a diameter larger than 80 mm which is impossible for traditional production equipment, thereby greatly improving production efficiency and saving labor costs and material resources to bring huge economic benefits.

BRIEF DESCRIPTION OF THE DRAWINGS

The present disclosure will be further described in detail below with reference to the accompanying drawings and specific embodiments.

REFERENCE NUMERALS

1, steel wires of Z-shaped steel wire outer layer; 2, steel wires of circular steel wire inner layer; 3, steel wires of central metal core; 4, gland; 5, braking device; 6, nut; 7, thimble sleeve; 8, roller; 10, framework body; 20, spool; 30, spool axle.

DETAILED DESCRIPTION OF EMBODIMENTS

The present disclosure will be further described below with reference to specific embodiments.

Figure 1:
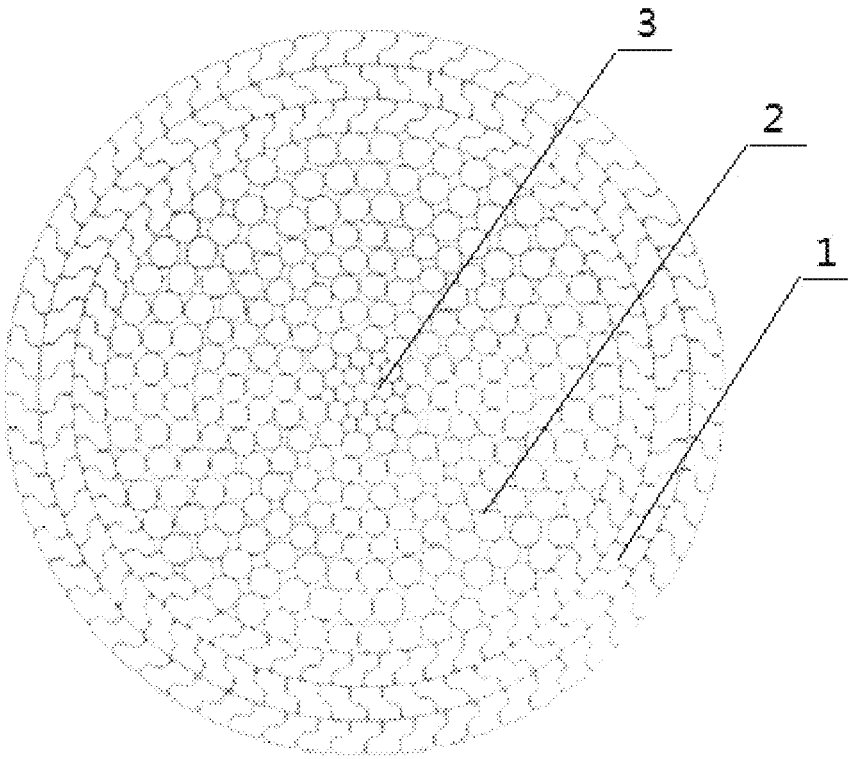
FIG. 1 is a schematic diagram of a locked coil wire rope according to an embodiment.

FIG. 1 is a schematic diagram of a locked coil wire rope according to an embodiment. In the embodiment as shown in FIG. 1, a locked coil wire rope includes more than 100 steel wires and has a diameter larger than 80 mm. Specifically, the locked coil wire rope includes a circular steel wire inner layer, a central metal core and a Z-shaped steel wire outer layer. The central metal core includes 19 steel wires 3 with a structure of 1×19W or 1×19S. The circular steel wire inner layer includes seven circular steel wire layers formed from a plurality of steel wires 2. The Z-shaped steel wire outer layer includes three Z-shaped steel wire layers formed from a plurality of Z-shaped steel wires 1. The number of steel wires 2 is 18 or more and Z-shaped the number of steel wires steel wires 1 is 51 or more.

In an embodiment, the diameter of the locked coil wire rope is 130 mm, and the structure of the central metal core is 1×31WS. The circular steel wire inner layer optionally includes seven circular steel wire layers, and the steel wires of the seven circular steel wire layers, from the inside out, is in a 18+24+30+36+42+42+48 form (i.e., seven steel wire layers consisting of a layer of 18 steel wires, a layer of 24 steel wires, . . . and a layer of 48 steel wires). The Z-shaped steel wire outer layer optionally includes three Z-shaped steel wire layers, and the steel wires of the three Z-shaped steel wire layers, from the inside out, is in a 57+64+71 form. For specific applications, the structure of the central metal core can be 1×31SW, and the structure of steel wires of the locked coil wire rope, from the outside out, is optionally in a 71Z6+64Z6+57Z6+48+42+42+36+30+24+18+31SW form.

In an embodiment, the diameter of the locked coil wire rope is 120 mm, and the structure of the central metal core is 1×31WS. The circular steel wire inner layer optionally includes six circular steel wire layers, and the steel wires of the six circular steel wire layers, from the inside out, is in a 18+24+30+33+39+45 form. The Z-shaped steel wire outer layer optionally includes three Z-shaped steel wire layers, and the steel wires of the three Z-shaped steel wire layers, from the inside out, is in a 51+58+65 form.

In the above embodiments, the central metal core and the circular steel wire inner layer individually have a tensile strength of 1870 MPa or more, and the Z-shaped steel wire outer layer has a tensile strength of 1770 MPa or more. A surface of the locked coil wire rope has a zinc-aluminium alloy coating with an aluminum content of more than 4.2% and a coating weight of more than 255 g/m$^2$. The surface of the zinc-aluminium alloy coating is unoiled. When implemented in this manner, the steel wires for the locked coil wire rope may be pre-coated.

By way of example, a method of manufacturing the locked coil wire rope with a diameter of 130 mm includes the following steps:

(1) Manufacture of Zinc-Aluminum Alloy-Coated Steel Wires

Processing parameters of the zinc-aluminum alloy-coated steel wires: drawing steel wires with steel grade 82B; DV value: 120; diameter: 2.0-8.0 mm; zinc temperature: 440±50° C.; zinc-aluminum alloy temperature: 450±50° C.; working speed: 22 m/min for diameter of 2.58-3.05 mm; 16 m/min for diameter of 4.03-5.15 mm; and the thickness of zinc coating and aluminum content meet requirements of Class A of GB/T20492-2006 standard "*Zinc-5% aluminum mischmetal alloy-coated steel wire and steel wire strand*".

(2) Manufacture of Locked Coil Wire Rope

Qualified zinc-aluminum alloy-coated steel wires are used to strand a core of 1×31SW on a tubular strander. A single strand of a circular wire then is separately stranded with a series of units. Finally a three-layer Z-shaped steel wire is closed using a closer. A wire separator is used in stranding and closing-up processes. Diameters of die holes of stranding dies are slightly smaller than the diameters of the strand and the steel wire rope by 0.5-2.0 mm. During stranding process, the tension of each wire is ensured to be even so that the steel wire rope is stranded tightly. The manufactured ZZZ-ϕ 130 mm zinc-aluminum alloy-coated locked coil wire rope has been tested by Testing Center, and all parameters meet the relevant standards and design requirements, which is suitable for spatial structure, large stadiums, tourism cableway, deep winding and other applications and is more competitive in the market.

It should be understood that in some embodiments, the structure of the central metal core of the locked coil wire rope may be 1×26WS, 1×49SWS or 1×55SWS.

In the manufacture of the above locked coil wire ropes, the central metal core is produced with the tubular strander in a one-stranding manner. A circular steel wire layer is then stranded with a series of multi-frame units by one stranding to form the circular steel wire inner layer. Finally, the Z-shaped steel wire layer is stranded layer by layer on a planetary closer. In specific implementations, the planetary closer may include six, eight or ten frames and each frame is provided with at least two spools.

Figure 2:
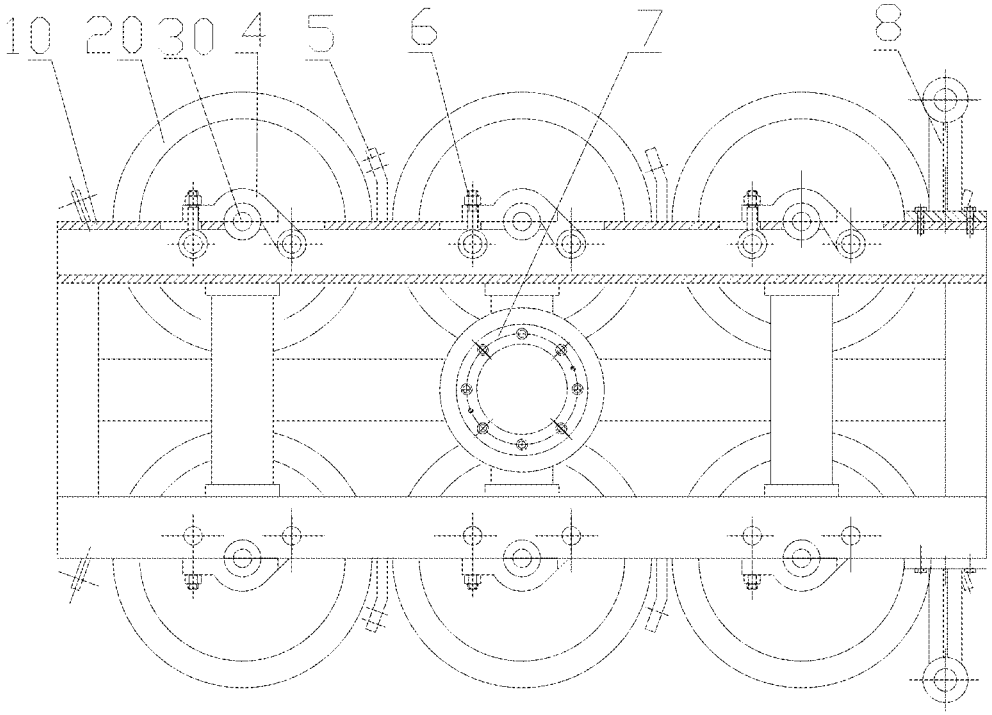
FIG. 2 is a front view of a capacity expansion framework according to an embodiment.
Figure 3:
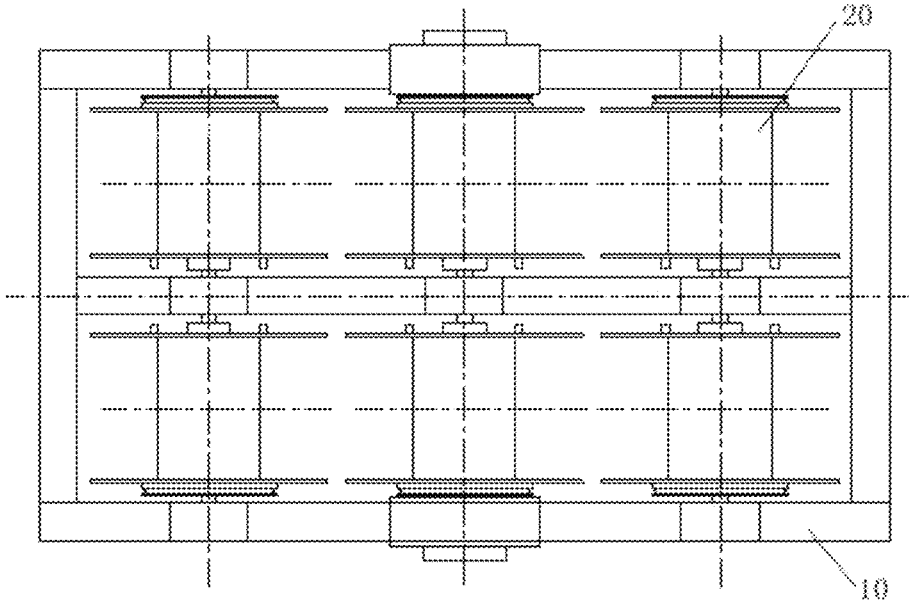
FIG. 3 is a top view of a capacity expansion framework according to an embodiment.

Since traditional closers can only accommodate a single large spool, an embodiment of the present invention further provides a capacity expansion framework to replace the traditional large spools. The capacity expansion framework is capable of producing the above locked coil wire ropes. By way of example, as shown in FIGS. 2-3, the capacity expansion framework according to an embodiment of the present disclosure includes a plurality of spools 20, a plurality of spool axles 30 and a framework body 10. The plurality of spools 20 are fixed on the framework body 10 through the plurality of spool axles 30. Each of the spool axles 30 is fixed through a gland 4, a screw and a nut 6. The framework body 10 is further provided with a plurality of braking devices 5, a thimble sleeve 7 and at least one roller 8. The braking devices 5 are used to brake the respective spools 20. Twelve spools 20 are arranged in two vertical layers, each layer including six spools 20 arranged in two rows and three columns cooperating with the corresponding roller 8. The thimble sleeve 7 is arranged between the two vertical layers. Particularly, the capacity expansion framework is assembled as follows: installing the spools 20 on the framework body 10; passing the spool axles 30 through center holes of spools 20; pressing the spool axles with the glands 4, and fixing the spool axles with the adjustable screws and nuts 6 to prevent the spools 20 from moving. The spools 20 adjust a tension through the braking devices 5 while paying off wires and the wires from the spools 20 are evenly distributed through the rollers 8. In specific implementations, the above capacity expansion framework may replace the spools of the traditional closer. With overall dimensions for mounting unchanged, the number of spools 20 is increased and the arrangement and size of the spools 20 are adapted to ensure the dynamic stability and even paying off during transmission of the framework. A form of framework-in-framework allows the capacity expansion framework to strand large-diameter wire rope with over 100 steel wires and the outermost layer steel wire of the locked coil wire rope with a diameter larger than 80 mm. The number of the spools 20 may be altered according to the specifications of the locked coil wire rope, and optionally the number of the spools 20 is 6 to 14. Further, with the use of the wire separator, the locked coil wire rope as of various specifications can be stranded. This breaks the bottleneck in capacity and production capability of traditional equipment, improving the efficiency of producing the locked coil wire ropes.

It should be understood that for those of ordinary skills in the art, improvements or variations can be made based on the above descriptions, and such improvements and variations fall within the scope of the appended claims.

The embodiments are only illustrative of the present disclosure, and apparently the implementations are not limited by the above modes. The embodiments described herein and various modifications based on the ideas and technical solutions of the present disclosure fall within the scope of the present application.

What is claimed is:

1. A locked coil wire rope, comprising:

a circular steel wire inner layer;

a central metal core;

a Z-shaped steel wire outer layer; and wherein the central metal core has a structure of 1×19W, 1×19S, 1×26WS, 1×31WS, 1×31SW, 1×49SWS or 1×55SWS; the circular steel inner layer comprises at least two circular steel wire layers, and each of the at least two circular steel wire layers has 18 or more steel wires; and the Z-shaped steel wire outer layer comprises at least one Z-shaped steel wire layer, and the Z-shaped steel wire layer has 51 or more steel wires.

2. The locked coil wire rope of claim 1, wherein the locked coil wire rope has a diameter of 130 mm and the central metal core has a structure of 1×31WS; the circular steel wire inner layer comprises seven circular steel wire layers; steel wires of the seven circular steel wire layers, from the inside out, are in a 18+24+30+36+42+42+48 form; the Z-shaped steel wire outer layer comprises three Z-shaped steel wire layers, and steel wires of the three Z-shaped steel wire layers, from the inside out, are in a 57+64+71 form.

3. The locked coil wire rope of claim 1, wherein the locked coil wire rope has a diameter of 120 mm and the central metal core has a structure of 1×31WS; the circular steel wire inner layer comprises six circular steel wire layers, and steel wires of the six circular steel wire layers, from the inside out, are in a 18+24+30+33+39+45 form; the Z-shaped steel wire outer layer comprises three Z-shaped steel wire layers, and steel wires of the three Z-shaped steel wire layers, from the inside out, are in a 51+58+65 form.

4. The locked coil wire rope of claim 1, wherein the central metal core and the circular steel wire inner layer individually have a tensile strength of 1870 MPa or more, and the Z-shaped steel wire outer layer has a tensile strength of 1770 MPa or more; a surface of the locked coil wire rope has a zinc-aluminium alloy coating with an aluminum content of more than 4.2% and a coating weight of more than 255 g/m$^2$; and a surface of the zinc-aluminium alloy coating is unoiled.

5. The locked coil wire rope of claim 1, wherein a cross section of the steel wires of the Z-shaped steel wire layer has a structure selected from one of $Z_3$, $Z_4$, $Z_5$, $Z_6$, $Z_7$ and $Z_8$.

6. A capacity expansion framework for producing the locked coil wire rope of claim 1, wherein the capacity expansion framework comprises at least six spools, at least six spool axles and a framework body; the spools are arranged on the framework body through the spool axles; the framework body is provided with braking devices configured to brake the spools.

7. The capacity expansion framework of claim 6, wherein the framework body is further provided with at least one roller configured to deliver steel wires evenly.

8. The capacity expansion framework of claim 6, wherein each of the spool axles is arranged on the framework body through a gland, a screw and a nut.

9. The capacity expansion framework of claim 6, wherein shape, size and position of the spools and spacing between the spools are adapted to the framework body.

* * * * *